US009347025B2

(12) United States Patent
Neplenbroek et al.

(10) Patent No.: US 9,347,025 B2
(45) **Date of Patent: *May 24, 2016**

(54) WARE WASHING SYSTEM CONTAINING CATIONIC STARCH

(71) Applicant: Diversey, Inc., Sturtevant, WI (US)

(72) Inventors: Antonius Maria Neplenbroek, Soest (NL); Julie Jessica Beau, Montrouge (FR); Florian Romain Marie Raphanel, Bordeaux (FR)

(73) Assignee: Diversey, Inc.

( * ) Notice: Subject to any disclaimer, the term of this patent is extended or adjusted under 35 U.S.C. 154(b) by 475 days.

This patent is subject to a terminal disclaimer.

(21) Appl. No.: 13/917,849

(22) Filed: Jun. 14, 2013

(65) Prior Publication Data

US 2013/0276833 A1 Oct. 24, 2013

Related U.S. Application Data

(63) Continuation of application No. 13/687,130, filed on Nov. 28, 2012, now Pat. No. 8,486,200, which is a continuation of application No. 13/132,271, filed as application No. PCT/US2009/066164 on Dec. 1, 2009, now Pat. No. 8,343,286.

(60) Provisional application No. 61/119,277, filed on Dec. 2, 2008.

(51) Int. Cl.

| | |
|---|---|
| ***B08B 9/20*** | (2006.01) |
| ***C11D 3/22*** | (2006.01) |
| *B08B 3/00* | (2006.01) |
| *B08B 3/04* | (2006.01) |
| *B08B 3/02* | (2006.01) |
| *A47L 15/44* | (2006.01) |
| *C11D 11/00* | (2006.01) |

(52) U.S. Cl.

CPC *C11D 3/22* (2013.01); *C11D 3/227* (2013.01); *C11D 11/0064* (2013.01); *A47L 15/44* (2013.01); *B08B 3/00* (2013.01); *B08B 3/02* (2013.01); *B08B 3/04* (2013.01); *C11D 3/222* (2013.01); *C11D 3/228* (2013.01); *C11D 11/0023* (2013.01); *C11D 11/0035* (2013.01)

(58) Field of Classification Search

CPC ..... B08B 3/04; B08B 3/00; B08B 3/02; A47L 15/44; C11D 3/222; C11D 3/227; C11D 3/228; C11D 11/0023; C11D 11/0035

See application file for complete search history.

(56) References Cited

U.S. PATENT DOCUMENTS

| | | | | |
|---|---|---|---|---|
| 3,320,118 | A * | 5/1967 | Black et al. | C11D 3/222 162/175 |
| 3,379,721 | A | 4/1968 | Reid | |
| 3,663,445 | A | 5/1972 | Augustin | |
| 4,663,159 | A | 5/1987 | Brode | |
| 6,025,314 | A | 2/2000 | Nitsch et al. | |
| 8,277,568 | B2 * | 10/2012 | Neplenbroek | C11D 11/0023 134/25.2 |
| 2003/0022804 | A1 | 1/2003 | Tadrowski | |
| 2006/0252664 | A1 * | 11/2006 | Cramer | C11D 3/3907 510/314 |
| 2008/0194453 | A1 | 8/2008 | Lang | |
| 2010/0154831 | A1 * | 6/2010 | Neplenbroek | C11D 3/222 123/25.2 |
| 2010/0224221 | A1 * | 9/2010 | Neplenbroek | C11D 11/0023 134/25.2 |

FOREIGN PATENT DOCUMENTS

| | | | |
|---|---|---|---|
| EP | 0467472 | | 1/1992 |
| EP | 0875555 | | 11/1998 |
| JP | 2007169473 A | * | 7/2007 |
| WO | WO94/26858 | | 11/1994 |
| WO | WO99/60086 | | 11/1999 |
| WO | WO 2004/113484 | | 12/2004 |
| WO | WO 2006/115658 | | 11/2006 |
| WO | WO2009006603 | * | 1/2009 |
| WO | WO 2010/065481 | | 6/2010 |

OTHER PUBLICATIONS

Notification of Reason for Refusal, Nov. 5, 2013.*

Office Action issued in CN Application No. 200980156024.3, Aug. 6, 2013.

English translation of Office Action issued in JP Application No. 2011-539622, Nov. 12, 2013.

* cited by examiner

*Primary Examiner* — Bibi Carrillo

(74) *Attorney, Agent, or Firm* — Bell & Manning, LLC

(57) ABSTRACT

The present invention discloses a method of washing ware, in particular in an automatic domestic or institutional ware washing machine, using a detergent composition containing a cationic starch. This eliminates the need for a surfactant in the rinse step. The cationic starch provides a layer of cationic starch on the ware so as to afford a sheeting action in an aqueous rinse step without any added rinse agent.

20 Claims, No Drawings

WARE WASHING SYSTEM CONTAINING CATIONIC STARCH

CROSS-REFERENCE TO RELATED APPLICATIONS

The present application is a continuation of U.S. patent application Ser. No. 13/687,130, filed Nov. 28, 2012 U.S. Pat. No. 8,486,200, which is a continuation of U.S. patent application Ser. No. 13/132,271, filed Jun. 1, 2011, now U.S. Pat. No. 8,343,286, which is a National Stage Entry under 35 U.S.C. §371 of PCT/US2009/066164, filed Dec. 1, 2009, which claims priority to U.S. Provisional Patent Application No. 61/119,277, filed Dec. 2, 2008, the entire contents of which are all hereby incorporated by reference.

BACKGROUND OF THE INVENTION

Warewash processes may involve at least two steps, a main wash and a rinse step. In the main wash, the substrates are cleaned by pumping main wash solution over the substrates via nozzles. This main wash solution is obtained by dissolving main wash detergent, which can contain components such as alkalinity agents, builders, bleaches, enzymes, surfactants for defoaming or cleaning, polymers, corrosion inhibitors etc. In the rinse step after the main wash, warm or hot water containing rinse aid solution is flown over the substrates, which can be followed by a hot air stream to further improve the drying process. The rinse aid typically consists of nonionics present in an amount of 10 to 30% in water; often in combination with hydrotropes and sometimes other additives such as polymers, silicones, acids, etc.

International patent application WO 2008/147940 (not pre-published) discloses the inclusion of a polysaccharide in the main wash detergent as a built-in rinse aid. This patent application discloses that polysaccharides adsorbing on the ware in the main wash process result in a sheeting action and good drying properties in all water qualities. The best drying properties are obtained with a cationic guar (e.g. Jaguar C1000), which provides very good drying on glass and metal substrates and reasonable drying on plastic materials.

JP 2007-169473 discloses a cleanser composition for dish washers comprising a cationized water-soluble polysaccharide and a nonionic surfactant, the weight ratio of the polysaccharide to nonionic surfactant being 3/1 to 1/10. In the Examples, the performance of three cationic celluloses and one cationic starch, together with nonionic surfactants, is reported. The weight ratios of nonionic surfactant to cationic starch varies in these examples from about 3/1 to 8/1. Firstly, cationic celluloses have the disadvantage that the high foam level created by these celluloses will limit their use for mechanical ware washing, because foam will reduce mechanical action in the washing process and so reduce cleaning of the substrates. Secondly, the high weight ratios of nonionic surfactant to cationic starch and the relatively high level of nonionic surfactant applied together with cationic starch were found to be disadvantageous for ware washing by having a negative effect with regard to cleaning and drying, providing chemical instability together with chlorine, providing substantial foaming, providing physical instability in liquid compositions, providing inferior flowing properties of solid compositions and hindering tablet or briquet production.

Surprisingly, it was now found that cationic starches overcome some of the limitations of cationic guars and cationic celluloses. Cationic starches can even further improve drying performance as compared to cationic guar, leading to very good drying on any type of substrate, including plastic materials. Cationic starches further have an improved performance when only low levels of nonionic surfactant are provided in the washing solution, in particular when no nonionic surfactant at all is provided. Furthermore, cationic starches have good non-foaming properties, much better than those of cationic celluloses. Even in combination with various soils only low levels of foam are formed in the mechanical warewashing process containing cationic starch, while a similar process with cationic guar will be much more sensitive for foam formation. Furthermore, cationic starches, as Hi-Cat CWS 42, are approved for indirect food contact and are easily available. Finally, cationic starches, such as Hi-Cat CWS 42, can be easily incorporated in solid granular detergents without the risk of phase separation. Segregation of particles is prevented due to the relatively large particle size of this cationic starch.

SUMMARY OF INVENTION

This invention relates to a ware washing process using a detergent that promotes soil removal in the washing stage and rinsing or rinse water sheeting in the rinsing stage.

DETAILED DESCRIPTION

A method of washing ware is provided using a detergent composition containing a cationic starch. The use of a cationic starch in the ware washing detergent advantageously provides an improved drying behaviour of the ware, when rinsing is performed with an aqueous rinse that is substantially free of an intentionally added rinse agent. The detergent composition may contain a nonionic surfactant, provided that the weight ratio of nonionic surfactant to cationic starch is at the most 1/1.

In particular, the method comprises:

contacting ware in a washing step with an aqueous cleaning composition in a ware washing machine, the aqueous cleaning composition comprising a major portion of an aqueous diluent and about 200 to 5000 parts by weight of a ware washing detergent per each one million parts of the aqueous diluent; and contacting the washed ware in a rinse step with an aqueous rinse, the aqueous rinse being substantially free of an intentionally added rinse agent, characterized in that the ware washing detergent contains a sufficient amount of a cationic starch to provide a layer of cationic starch on the ware so as to afford sheeting action in the aqueous rinse step, and in that when the ware washing detergent contains a nonionic surfactant, the weight ratio of nonionic surfactant to cationic starch is at the most 1/1, preferably at the most 0.75/1, more preferably at the most 0.5/1, most preferably at the most 0.25/1, and/or the concentration of nonionic surfactant in the aqueous cleaning solution is at the most 20 ppm, preferably at the most 10 ppm, more preferably at the most 5 ppm.

In an especially preferred embodiment, the aqueous cleaning solution does not contain a nonionic surfactant at all.

The cationic starch preferably constitutes 0.01% to 50% (w/w) of the detergent, more preferably 0.1% to 20% (w/w), even more preferably 0.2 to 10% (w/w), even more preferably 0.5% to 5% (w/w), most preferably 1 to 5%, based on total (wet or dry) weight of the detergent composition.

Typically, the concentration of the cationic starch in the aqueous cleaning composition, i.e. the aqueous wash solution, is from 1 to 100 ppm, preferably from 2 to 50 ppm, more preferably from 5 to 50 ppm.

The cationic starch typically is added to the cleaning composition as part of the detergent. However, it is also possible to add the cationic starch to the cleaning composition as a separately formulated product. Such a separately formulated product may contain a relatively high level (even 100%) of cationic starch. This separate product, which can be liquid or solid, may be dosed manually or automatically. This may for instance be done to boost the drying of specific substrates, for instance when washing difficult to dry plastic trays, or to solve stability issues between the cationic starch and the main wash detergent. In this way, the level of cationic starch in the main wash can be adjusted flexibly and independently from the main wash detergent, to provide a layer of cationic starch on the ware so as to afford a sheeting action in the aqueous rinse step.

In the rinse step, the washed ware is contacted with an aqueous rinse. The aqueous rinse is substantially free from an intentionally added rinse agent (also called rinse aid). Preferably, no rinse agent at all is intentionally added to the aqueous rinse.

The cationic starch is present in the ware washing detergent in a sufficient amount to provide a layer on the ware so as to afford sheeting action in the aqueous rinse step. A cationic starch that is suitable for use in the ware washing detergent should sufficiently adsorb on a solid surface to provide overall improved drying behavior, such as reduced drying time and/or reduced remaining number of droplets, of the ware.

To determine the suitability of cationic starches for the method of this invention, the drying behavior of a substrate is compared under identical conditions using an institutional ware washing process comprising a main wash step and a rinse step, wherein a detergent composition is used in the main wash step with or without the presence of cationic starch, followed by a rinse step with fresh soft water, i.e. water without added rinse aid. Soft water with a water hardness of at the most one German Hardness is used for this test, both for the main wash and for the rinse.

Drying behavior is measured on 3 different types of substrates. These are coupons which typically are very difficult to dry in an institutional ware washing process without the use of rinse components. These substrates are:

2 glass coupons (148*79*4 mm)

2 plastic (Nytralon 6E' (Quadrant Engineering Plastic Products); naturel) coupons (97*97*3 mm)

2 stainless steel cups (110*65*32 mm), model: Le Chef, supplier: Elektroblok BV.

The drying behavior is measured as drying time (seconds) and as residual amount of droplets after 5 minutes. Measurements typically are started immediately after opening the machine.

The drying behavior with cationic starches added to the main wash can also be quantified by the drying coefficient. This can be calculated both for the drying time and the number of remaining droplets after 5 minutes and is corresponding to the ratio:

$$\frac{\text{Drying time using detergent with cationic starch}}{\text{Drying time using detergent without cationic starch}}$$

and/or $$\frac{\text{Number of droplets after 5 minutes using detergent with cationic starch}}{\text{Number of droplets after 5 minutes using detergent without cationic starch}}$$

A better drying behavior corresponds with a lower drying coefficient. Average drying coefficients are calculated as the average values for all 3 different substrates.

A cationic starch that is suitable for use in the method of the invention provides:

an average drying coefficient based on drying time being at the most 0.9, preferably at the most 0.8, more preferably at the most 0.7, even more preferably at the most 0.6, even more preferably at the most 0.5, even more preferably at the most 0.4, most preferably at the most 0.3, as being measured under identical conditions except for presence or absence of the cationic starch to be tested in the detergent. The lower limit of this ratio typically may be about 0.1, and/or an average drying coefficient based on remaining number of droplets being at the most 0.5, preferably at the most 0.4, more preferably at the most 0.3, even more preferably at the most 0.2, most preferably at the most 0.1, as being measured under identical conditions except for presence or absence of the cationic starch to be tested in the detergent. The lower limit of this ratio may be 0.

The concentration of the tested cationic starch typically is 2 to 5% (w/w) in the detergent composition, and 20 to 50 ppm in the wash solution.

Care should be taken to choose such test conditions that provide proper differences in drying behavior with and without cationic starch. For instance, those conditions are suitable that give a proper difference in drying when comparing a process with a common rinse aid added to the rinse water with a process using the same detergent (in which no cationic starch is present) and a rinse step with fresh water. In a process without using a rinse aid in the rinse water, the substrates typically are not dried within 5 minutes, giving an average number of remaining droplets between 5 and 25, while in the process with rinse aid the average number of remaining droplets is less than half of this number. Suitable conditions are for instance those of example 1. A common rinse aid may be a nonionic surfactant dosed at about 100 ppm in the rinse water; for instance Rinse Aid A (see example 1).

The detergent composition that may be used for this comparison typically contains phosphate, metasilicate and hypochlorite, e.g. 0.40 g/l sodium tripolyphosphate+0.52 g/l sodium metasilicate+0.02 g/l dichloroisocyanuric acid Na-salt.2aq (NaDCCA).

Cationic Starches

As defined herein, a cationic starch is a starch containing a cationic group. The cationic charge on the cationic starch may be derived from ammonium groups, quaternary ammonium groups, guanidium groups, sulfonium groups, phosphonium groups, bound transition metals, and other positively charged functional groups.

A preferred cationic group is a quaternary ammonium group according to the formula

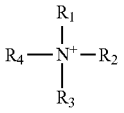

wherein $R_1$, $R_2$, $R_3$ and $R_4$ each independently are a lower alkyl or a lower hydroxyalkyl group. More preferably $R_1$, $R_2$, $R_3$ and $R_4$ each independently are a C1-C6 alkyl or a C1-C6 hydroxyalkyl group. Even more preferably, $R_1$, $R_2$ and $R_3$ are identical C1-C4 alkyl groups and $R_4$ is a C3-C6 hydroxyalkyl group. Even more preferably, $R_1$, $R_2$ and $R_3$ are methyl groups and $R_4$ is a C3-C6 hydroxyalkyl group. Most preferred the cationic group is a quaternary 2-hydroxy-3-(trimethylammonium)propyl group.

A cationic group may be connected to the starch via an ether or an ester linkage.

The starch component of the cationic starch may be a starch derived from a natural source, such as rice, tapioca, wheat, corn or potato. It may be a partially hydrolysed starch, which may be advantageous for liquid detergent compositions, It further may contain substituents and/or it may be hydrophobically modified.

Preferred are cationic starches modified with a 2-hydroxy-3-(trimethylammonium)propyl group, such as (3-Chloro-2-Hydroxypropyl)Trimethylammonium Chloride modified starch. Suitable cationic starches are sold under the trade name HI-CAT by Roquette, SolsaCAT by PT. Starch Solution Internasional Kawasan, CATO by National Starch & Chemical, Mermaid by Shikishima Starch and Excell by Nippon Starch Chemical.

Particularly preferred are the following cationic starches: HI-CAT CWS 42 (Roquette), SolsaCAT 16, 16 A, 22, 22A, 33 and 55 A (cationic tapioca starch derivatives from PT. Starch Solution Internasional Kawasan), CATO 304, 306 and 308 (Cationic tapioca starches from National Starch & Chemical Limited), Mermaid M-350B (α-Cationic Starch from Shikishima Starch CO. LTD), Excell DH and Excell NL (Hydrolized cationic starch, hydrogenated from Nippon Starch Chemical Co Ltd.).

The cationic starches can be used alone or in combination with other polysaccharides or with polymeric or nonionic surfactants as described in WO2006/119162 in the detergent composition.

Cationic starches, may be combined with certain anions, such as silicate and/or phosphonate and/or phosphate and/or EDTA and/or MGDA and/or NTA and/or IDS and/or hydroxide and/or citrate and/or gluconate and/or lactate and/or acetate anions. Both for liquid and solid compositions, properties like product stability, level of actives in the composition and drying performance can be influenced by the type of anion. For a liquid detergent, these properties may be influenced further by the order of addition of the starch and anion components when making these compositions. For a solid detergent, these properties may be influenced further by the granule or the powder structure and the dissolution behaviour of the composition. Finally, the complexation product between the cationic starch and an anion will affect the drying properties of the cationic starch in various water qualities.

Detergent Composition

In addition to the cationic starches described herein above, the detergent compositions may comprise conventional ingredients, preferably selected from alkalinity sources, builders (i.e. detergency builders including the class of chelating agents/sequestering agents), bleaching systems, anti-scalants, corrosion inhibitors, surfactants, antifoams and/or enzymes. Suitable caustic agents include alkali metal hydroxides, e.g. sodium or potassium hydroxides, and alkali metal silicates, e.g. sodium metasilicate. Especially effective is sodium silicate having a mole ratio of $SiO_2$:$Na_2O$ of from about 1.0 to about 3.3. The pH of the detergent composition typically is in the alkaline region, preferably ≥9, more preferably ≥10.

Builder Materials

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylglycine diacetic acid (MGDA); glutaric diacetic acid (GLDA), polycarboxylates such as polymaleates, polyacetates, polyhydroxyacrylates, polyacrylate/polymaleate and polyacrylate/polymethacrylate copolymers, as well as zeolites; layered silicas and mixtures thereof. They may be present (in % by wt.), in the range of from 1 to 70, and preferably from 5 to 60, more preferably from 10 to 60.

Particularly preferred builders are phosphates, NTA, EDTA, MGDA, GLDA, IDS, citrates, carbonates, bicarbonates, polyacrylate/polymaleate, maleic anhydride/(meth) acrylic acid copolymers, e.g. Sokalan CP5 available from BASF.

Antiscalants

Scale formation on dishes and machine parts can be a significant problem. It can arise from a number of sources but, primarily it results from precipitation of either alkaline earth metal carbonates, phosphates or silicates. Calcium carbonate and phosphates are the most significant problem. To reduce this problem, ingredients to minimize scale formation can be incorporated into the composition. These include polyacrylates of molecular weight from 1,000 to 400,000, examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Huls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcosperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-sealant, if present, is included in the composition from about 0.05% to about 10% by weight, preferably from 0.1% to about 5% by weight, most preferably from about 0.2% to about 5% by weight.

When using anionic polymers (among which acrylic polymers or polymers based on acrylic acid combined with other moieties, such as Sokalan CP5) as antiscalants, there may occur a negative interaction with cationic starch, which may result in a reduced drying performance. In one embodiment of the invention, the concentration of such polymers may therefore be reduced or non-polymeric antiscalants may be used.

Surfactants

Surfactants and especially nonionics may be present to enhance cleaning and/or to act as defoamer. Typically used nonionics are obtained by the condensation of alkylene oxide groups with an organic hydrophobic material which may be aliphatic or alkyl aromatic in nature, e.g. selected from the group consisting of a C2-C18 alcohol alkoxylate having EO, PO, BO and PEO moieties or a polyalkylene oxide block copolymer.

The surfactant may be present in a concentration of about 0% to about 10% by weight, preferably from 0.5% to about 5% by weight, most preferably from about 0.2% to about 2% by weight. Due to the effect of the cationic starch as described herein, the non-ionic surfactant level in detergent formulations may be lowered to at the most 2% by weight. A nonionic surfactant may thus be present, but should preferably be applied in a concentration providing a level of at the most 20 ppm non-ionic surfactant in the aqueous cleaning solution, and/or should be applied in a concentration providing a weight ratio of nonionic surfactant to cationic starch of at the most 1/1. Advantageously, no nonionic surfactant at all is present in the detergent formulation.

Bleaches

Suitable bleaches for use in the system according the present invention may be halogen-based bleaches or oxygen-based bleaches. More than one kind of bleach may be used.

As halogen bleach, alkali metal hypochlorite may be used. Other suitable halogen bleaches are alkali metal salts of di- and tri-chloro and di- and tri-bromo cyanuric acids. Suitable oxygen-based bleaches are the peroxygen bleaches, such as sodium perborate (tetra- or monohydrate), sodium carbonate or hydrogen peroxide.

The amounts of hypochlorite, di-chloro cyanuric acid and sodium perborate or percarbonate preferably do not exceed 15%, and 25% by weight, respectively, e.g. from 1-10% and from 4-25% and by weight, respectively.

Antifoams

For solid detergents in the form of a powder, granulated powder, tablet, briquette or solid block the use of a solid defoaming agent might be preferred. Examples of suitable solid defoamers are: SILFOAM® SP 150 (ex Wacker Chemie AG; Silicone Antifoam Powder) or DC 2-4248S (ex Dow Corning; powdered antifoam).

Enzymes

Amylolytic and/or proteolytic enzymes would normally be used as an enzymatic component. The enzymes usable herein can be those derived from bacteria or fungi.

Minor amounts of various other components may be present in the chemical cleaning system. These include solvents, and hydrotropes such as ethanol, isopropanol and xylene sulfonates, flow control agents; enzyme stabilizing agents; anti-redeposition agents; corrosion inhibitors; and other functional additives.

Components of the detergent composition may independently be formulated in the form of solids (optionally to be dissolved before use), aqueous liquids or non-aqueous liquid (optionally to be diluted before use).

The ware washing detergent may be in the form of a liquid or a powder. The powder may be a granular powder. When in powder form, a flow aid may be present to provide good flow properties and to prevent lump formation of the powder. The detergent preferably may be in the form of a tablet or a solid block. Also preferably, the detergent may be a combination of powder and tablet in a sachet, to provide a unit dose for several washes. The liquid may be a conventional liquid, structured liquid or gel form.

The cationic starch can be incorporated rather easily in main wash detergents like tablets, blocks, powders or granules without sacrificing physical properties like flow and stability. The cationic starch, incorporated in the wash detergent, can be in a liquid form, but also in solid form.

The chemical cleaning method may be utilized in any of the conventional automatic institutional or domestic ware washing processes.

Typical institutional ware washing processes are either continuous or non-continuous and are conducted in either a single tank or a multi-tank/conveyor type machine. In the conveyor system pre-wash, wash, post-rinse and drying zones are generally established using partitions. Wash water is introduced into the rinsing zone and is passed cascade fashion back towards the pre-wash zone while the dirty dishware is transported in a counter-current direction.

Typically, an institutional warewash machine is operated at a temperature of between 45-65° C. in the washing step and about 80-90° C. in the rinse step. The washing step typically does not exceed 10 minutes, or even does not exceed 5 minutes. In addition, the aqueous rinse step typically does not exceed 2 minutes.

It is envisaged to dose the detergent in the ware washing process in a concentrated version, e.g. using about 10% of the common amount of aqueous diluent, and to add the remaining 90% of the aqueous diluent in a later stage of the washing process, e.g. after 10 to 30 seconds contact time of the ware with the concentrated detergent, such as performed in the Divojet® concept of JohnsonDiversey.

It is also envisaged to use the ware washing detergent for periodically treating the ware. A treatment using a detergent comprising cationic starch as described herein may be alternated with one or more washings using a detergent without cationic starch. Such a periodic treatment may be done with a relatively high concentration of cationic starch in the detergent, providing e.g. 50 to 500 ppm cationic starch in the wash solution.

Surprisingly, it was found that the cleaning method using a detergent comprising a cationic starch as described herein also performs very well in domestic ware washing processes. Even under domestic ware washing conditions, where the rinse step is substantially longer as compared to institutional processes, the cationic starch as described herein provided a layer on the ware so as to afford a sheeting action in the aqueous rinse step.

The detergent comprising a cationic starch as described herein also performs very well when soft water, or even reverse osmosis water, is used in the rinse step, and optionally also in the wash step. Reverse osmosis water is often used for warewashing when high visual appearance of substrates, especially glasses, is important, because this type of water leaves no water residues. However, using standard rinse aids can have a negative effect on visual appearance (because of non-ionic residues), or spots can be formed when drying is not perfect.

Surprisingly, it was found that the detergent comprising a cationic starch as described herein provides proper drying on various substrates; not only on glass, ceramic and metal materials, but also on plastic substrates. Furthermore, the detergent comprising a cationic starch is not sensitive to foam formation. Even in combination with various soils only low levels of foam are formed in de mechanical warewashing process. Furthermore, cationic starches, such as Hi-Cat CWS 42, can be easily incorporated in solid granular detergents without the risk of phase separation. Segregation of particles is prevented due to the relatively large particle size of this cationic starch. In addition cationic starches, as Hi-Cat CWS 42, are approved for indirect food contact and are easily available.

With this concept of built-in rinse aid, a simpler wash process is obtained for institutional and domestic ware washing, which eliminates the need for using a separate rinse aid.

Besides increased simplicity, this concept provides clear cost savings, like for raw materials, packaging, processing, transport and storage of the separate rinse aid, but also by eliminating the need for a pump to dose the rinse aid into the rinse solution.

The optimal drying behaviour obtained by the built-in rinse aid concept with cationic starches may also reduce the electrostatic properties of the substrates.

The cationic starch which provides optimal drying properties in this concept of built-in rinse aid for ware washing processes can have some cleaning, defoaming, builder, binder, rheology modifying, thickening, structuring, scale preventing or corrosion inhibiting properties as well and so improve the overall wash process. In particular, a reduced scale build up was observed as compared to a similar system without built-in rinse aid and rinsing with water only. In addition, no effect on beer foam properties was observed as compared to a standard rinse process where nonionics from the rinse aid left behind on the glasses typically suppress the foam. Also, a positive soil release effect on fatty type of soils was observed.

This invention will be better understood from the Examples which follow. However, one skilled in the art will readily appreciate that the specific methods and results discussed are merely illustrative of the invention and no limitation of the invention is implied.

Example 1

In this example the drying behavior of various substrates is tested in an institutional single tank warewash machine. A standard institutional wash process with soft water is applied for this test with a main wash process containing especially phosphate, metasilicate and hypochlorite.

First (test 1: reference) the drying behavior is determined for a wash process in which no rinse components are present (not dosed via the separate rinse and not added to the main wash process). In this case, the mainwash contains only the main wash powder (especially phosphate, metasilicate and hypochlorite) dosed at 1 g/L and the rinse is done with fresh soft water.

Then (test 2) the drying behavior is determined for the same main wash composition as test 1, in combination with a separately dosed rinse aid. This is a representative standard institutional dish wash process in which drying of the substrates is obtained by rinsing with a rinse solution in which rinse aid is dosed. These rinse components are dosed via a separate rinse pump just before the boiler into the last rinse water. Rinse Aid A is used as representative rinse aid for institutional ware washing. This neutral rinse aid contains about 30% of a non-ionic mixture. By dosing this rinse aid at a level of 0.3 g/L, the concentration of non-ionics in the rinse solution is about 90 ppm. Key components of Rinse Aid A are given in the table 1 below.

TABLE 1

Composition of Rinse Aid A

| As supplied | Raw material | Trade name |
|---|---|---|
| 22.5% | Alcohol (C13-15) alkoxylate (EO/BO) (95%) | Plurafac LF221 |
| 7.5% | Alcohol alkoxylate (EO/PO) | Plurafac LF403 |
| 5.0% | Cumene sulphonic acid Na-salt (40%) | Eltesol SC40 |
| 65.0% | Water | Water |

Then (tests 3, 4 and 5) the drying behavior was determined for wash processes in which no rinse component was dosed in the separate rinsed (so rinsed only with fresh soft water) but where different powder based products were added to the main wash at 1 g/L.

In test 3 a cationic guar was present in the main wash solution: Jaguar C 1000; ex Rhodia; Guar gum, 2 hydroxy-3-(trimethylammonium)propyl ether chloride (CAS Nr: 65497-29-2). This polysaccharide was selected because it provided the best drying properties in similar trials, described in WO 2008/147940

In test 4 and test 5 a cationic starch was present in the main wash solution: HI-CAT CWS 42 ex Roquette Freres; cold water soluble cationic potato starch (CAS Nr: 56780-58-6).

The composition of these detergents are given in table 2.

TABLE 2

Composition of detergents

| Raw material | Test 1 | Test 3 | Test 4 | Test 5 |
|---|---|---|---|---|
| Sodium tripoly phosphate | 40% | 40% | 40% | 40% |
| Sodium meta silicate | 56.6% | 54.1% | 53.6% | 17% |
| Sodium disilicate | | | | 23.6% |
| Sodium carbonate | | | | 13% |
| Dichloroisocyanuric acid Na-salt 2 aq. | 2.4% | 2.4% | 2.4% | 2.4% |
| Briquest 442 (ex Rhodia) | 1% | 1% | 1% | 1% |
| Jaguar C1000 (ex Rhodia) | | 2.5% | | |
| Hi Cat CWS 42 (ex Roquette) | | | 3% | 3% |

The warewasher used for these tests was a Hobart-single tank hood machine, which is automated for laboratory testing, such that the hood is opened and closed automatically and the rack with ware is transported automatically into and out off the machine.

Specifications Single Tank Hood Machine

Type: Hobart AUX70E

Volume washbath: 50 L

Volume rinse: 4 L

Wash time: 65 seconds

Rinse time: 8 seconds

Wash temperature: 45° C.

Rinse temperature: 80° C.

Water: soft water (water hardness: <1 DH).

Working Method

When the wash bath is filled with soft water and heated up, the wash program is started. The washwater will be circulated in the machine by the internal wash pump and the wash arms over the dishware. When the wash time is over, the wash pump will stop and the wash water will stay in the reservoir below the substrates. Then 4 L of the wash bath will be drained automatically by a pump into the drain. Then the rinse program will start; fresh warm water from the boiler (connected to the soft water reservoir) will be rinsed by the rinse arms over the dishware. When the rinse time is over the machine is opened.

It should be noticed that (in contrast to consumer type of dishwash machines) only fresh soft water is rinsed over the substrates: no components from the main wash process can dissolve in the rinse water. The wash pump and wash arms and nozzles are not used for rinsing and the rinse water is not circulating in the wash tank during rinsing.

Once the machine is filled with soft water and temperature of water is 45° C., the powder based products are added via a plate on the rack to provide 1 g/L in the wash bath. One wash cycle is done to be sure that the product is totally dissolved.

Drying times are measured on 3 different types of substrates. These substrates are selected because they are difficult to dry in an institutional warewash process without rinse components and only moderately dried with a standard rinse aid process. These substrates are made of the following, practically relevant, materials: 2 glass coupons (148*79*4 mm); 2 plastic (Nytralon 6E'(Quadrant Engineering Plastic Products); naturel) coupons (97*97*3 mm); 2 stainless steel cups (110*65*32 mm), model: Le Chef, supplier: Elektroblok BV.

After the wash cycle and rinse cycle the drying time is determined (in seconds) of the washed substrates at ambient temperature. When drying time is longer than 300 s, it is reported as 300 s. However, many of the substrates are not dried within five minutes. In that case, the remaining droplets on the substrates are also counted.

The wash cycle and drying time measurements are repeated two more times with the same substrates without adding any chemicals. The substrates are replaced for every new test (in order not to influence the drying results by components possibly adsorbed onto the ware).

In table 3 the drying results for these wash processes are given. For each substrate the average values of the drying times and the average values of the number of droplets on the substrates after five minutes for the 3 repeat tests are given.

TABLE 3 drying results in an institutional warewashmachine

| | Stainless Steel | | Glass | | Plastic | |
|---|---|---|---|---|---|---|
| Test | Time sec. | Droplets # | Time sec. | Droplets # | Time sec. | Droplets # |
| 1 Reference | 300 | 11 | 300 | 7 | 300 | 8 |
| 2 Reference + separate rinse aid A | 293 | 1 | 120 | 0 | 227 | 1 |
| 3 Cationic guar | 35 | 0 | 31 | 0 | 243 | 3 |
| 4 Cationic starch | 32 | 0 | 59 | 0 | 132 | 0 |
| 5 Cationic starch | 94 | 0 | 69 | 0 | 193 | 0 |

Drying Coefficient

The drying behavior of these detergents can also be quantified by the drying coefficient. This can be calculated both for the drying time and the number of remaining droplets after 5 minutes and is corresponding to the ratio:

$$\frac{\text{Drying time using detergent with added component}}{\text{Drying time using detergent without added component (reference test 1)}}$$

and/or $$\frac{\text{Number of droplets after 5 minutes using detergent with added component}}{\text{Number of droplets after 5 minutes using detergent without added component}}$$

A better drying behavior corresponds with a lower drying coefficient.

In table 4 the drying coefficients are calculated for the various wash processes. The drying coefficients are calculated as the average value for all 3 different substrates. In the same way, the drying coefficients are calculated for the wash process with standard separate rinse aid (test 2) as compared to reference test 1.

TABLE 4

Average drying coefficients

| | Drying Coefficient | |
|---|---|---|
| Test | Drying time | Number of remaining droplets |
| 2 Reference + separate rinse aid A | 0.71 | 0.07 |
| 3 Cationic guar | 0.34 | 0.13 |
| 4 Cationic starch | 0.25 | 0.00 |
| 5 Cationic starch | 0.40 | 0.00 |

Reference test 1 shows that the substrates are not dried properly when no rinse components are present in the wash proces or in the final rinse. Many droplets are left behind on all selected substrates, even after 5 minutes.

The results of test 2 confirm that indeed these substrates are difficult to dry. Under these current standard wash and rinse conditions, only the glass coupons get dried, while on the plastic and stainless steel substrates still some water droplets are left behind after 5 minutes. But this drying with standard separate rinse is much better than for reference test 1 without any rinse components.

Test 3 shows that the presence of Jaguar C1000 in the main wash detergent leads to very good drying properties under these conditions, where is rinsed with fresh soft water only. This result is in line with the findings as described in International patent application WO 2008/147940.

Test 4 and test 5 show that the presence of Hi Cat CWS 42 in the main wash detergent also leads to very good drying properties under these conditions, where is rinsed with fresh soft water only. This drying behavior is significantly better than for test 2, in which a separate rinse aid is used. This result also shows that drying of the plastic substrate is better with this cationic starch than with Jaguar C1000 present in the main wash solution.

The drying coefficients confirm the excellent drying properties of cationic starch added to the main wash. Both for tests 4 and 5 the drying coefficient based on remaining droplets is 0 (and so much lower than 0.5) and/or the drying coefficient based on drying time is much lower than 0.9.

Further trials showed that the granular powder based products from test 4 and 5 are physically stable. No segregation effects were observed, also not after mechanically shaking 5 kg product in a bottle for 1 hour. Product samples from different places in the bottle all provided comparable perfect drying as shown in table 3. Obviously, the cationic starch Hi Cat CWS 42 is less sensitve for segregation than the fine powder Jaguar C1000, which needed a special processing method to prevent segregation, as described in example 4 of International patent application WO 2008/147940.

Example 2

In this example the drying behavior of various substrates was tested in a domestic warewash machine. A standard wash process with tap water was applied for this test with a main wash process containing especially phosphate and metasilicate.

First (test 1) the drying behavior of this process without any rinse component was determined. In this reference test no rinse component was present in the main wash solution and no rinse component was dosed in the last rinse with water.

Then (test 2) the drying behavior of this process with a commercially available 'Sun All in 1' tablet was determined. 'Sun All in 1' tablets are one of the leading products in the domestic market for dishwash tablets containing built in rinse aid. In this 'benchmark test' no rinse component was dosed in the last rinse with water.

Finally (test 3) the drying behavior was determined for a wash process in which a cationic potato starch was present in the main detergent product and no rinse component was dosed in the last rinse with water.

The warewasher used for these tests was a Bosch SMG 3002, Tap water, with a water hardness of 8 German Hardness, was used for these tests. The automated Eco-process was applied for these tests. This process starts with a wash process of about 30 minutes, the wash solution is heated to about 55° C.; followed by the last rinse process of about 15 minutes with fresh water; followed by a drying step of about 5 minutes.

Similar coupons as described in example 1 were used for these tests. These coupons were placed in the rack at the start of the test and evaluated at the end of the wash process, in the same way as described in example 1.

In test 2, one 'Sun all in 1' tablet with a weight of 22 gram was added to the wash process. The same weight of 22 gram detergent was added in test 1 and test 3. The compositions of these detergents are given in table 5.

TABLE 5 compositions detergents test 1 and test 3

| Raw material | Test 1 'Reference' | Test 3: 'Cationic starch' |
|---|---|---|
| Sodium tripoly phosphate (LV HP ex Rhodia) | 40% | 40% |
| Degressal SD20 (ex BASF) | 1% | 1% |
| Sodium meta silicate | 55.5% | 52.5% |
| Magnesium Stearate | 0.1% | 0.1% |
| Dichloroisocyanuric acid Na-salt 2 aq. | 2.4% | 2.4% |
| Briquest 442 (ex Rhodia) | 1% | 1% |
| Hi Cat CWS 42 (ex Roquette) | — | 3% |

In table 6 the drying results for these wash processes are given.

TABLE 6 drying results in a domestic warewashmachine

| | Stainless Steel | | Glass | | Plastic | |
|---|---|---|---|---|---|---|
| Test | Time; Sec. | Droplets # | Time; Sec. | Droplets # | Time; Sec. | Droplets # |
| 1 Reference test | 300 | 38 | 300 | 7 | 300 | 17 |
| 2 Benchmark test: 'Sun All in 1' tablet | 300 | 21 | 255 | 1 | 300 | 6 |
| 3 Cationic starch | 172 | 0 | 25 | 0 | 185 | 0 |

The following drying coefficients can be calculated (as described in example 1 compared to reference test 1).

TABLE 7 drying coefficients for domestic warewashmachine

| | Drying Coefficient | |
|---|---|---|
| | Drying time | Number of remaining droplets |
| Bench mark test 2: 'Sun All in 1' | 0.95 | 0.35 |
| Test 3: Cationic starch | 0.42 | 0 |

Reference test 1 shows that the substrates are not dried properly when no rinse components are present in the wash proces or in the final rinse.

Bench mark test 2 shows that 'Sun all in 1' tablets have a positive effect on drying of these substrates. Especially the number of remaining droplets is less as compared to the reference test. But the drying behavior is not perfect. This result is in line with general experiences that drying in domestic dishwash machines by these tablets with built-in rinse components is often inferior to drying by adding rinse components into the rinse via a separate rinse aid.

Test 3 shows that the presence of Hi Cat CWS 42 in the main wash detergent leads to very good drying. This drying behavior is significantly better than the drying behavior with 'Sun all in 1' tablets. The substrates get totally dried in this process with Hi Cat CWS 42 in the main wash and no rinse component dosed in the last rinse with water. It can be concluded that a main wash detergent containing cationic starch also provides proper drying under these conditions in a domestic ware washing process.

Example 3

In this example the drying behaviour is tested in an institutional single tank machine for several liquid based detergents containing a cationic starch: Hi Cat CWS 42. These liquid detergents are based on different builders. The following liquid detergents were made by adding the raw materials in given order at 50 c degrees.

TABLE 8 compositions liquid detergents

| Raw material | Test 1 Reference | Test 2 | Test 3 | Test 4 |
|---|---|---|---|---|
| Soft water | 45% | 44% | 31% | 44% |
| STP MD granules | 10% | 10% | | |
| KTP 50% solution | 10% | 10% | | |
| Caustic potash (50% KOH solution) | 35% | 35% | | |
| Dequest 2000 (ex Thermphos) | | | 5% | |
| Caustic soda (50% NaOH solution) | | | 15% | 5% |
| Trilon A liquid (40% NTA-Na3 ex BASF) | | | 48% | |
| GLDA 38% solution | | | | 50% |
| Hi Cat CWS 42 (Roquette) | | 1% | 1% | 1% |

Drying tests were carried out with the same test method and similar test conditions as described in example 1. In this example the temperature of the main wash solution was 50 degrees C., while the wash time was 29 seconds. Each of the liquid based products were dosed at 2 g/L to the wash bath and soft water was used for these tests. The rinse was done with fresh soft water only. The drying results are given m table 9.

TABLE 9 drying results for liquid detergents in an institutional ware washing machine

| Test | Stainless steel Time sec. | Stainless steel Droplets | Glass Time sec. | Glass Droplets | Plastic Time sec. | Plastic Droplets |
|---|---|---|---|---|---|---|
| 1 Reference | 300 | 19 | 300 | 3 | 300 | 19 |
| 2 STP/KTP based | 49 | 0 | 40 | 0 | 279 | 2 |
| 3 NTA based | 60 | 0 | 44 | 0 | 237 | 1 |
| 4 GLDA based | 53 | 0 | 54 | 0 | 118 | 0 |

The following average drying coefficients can be calculated (as described in example 1), compared to reference test 1.

TABLE 10 drying coefficients for liquid detergents in an institutional ware washing machine

| Test | Drying Coefficient: Drying time | Drying Coefficient: Number of remaining droplets |
|---|---|---|
| 2 STP/KTP based | 0.41 | 0.05 |
| 3 NTA based | 0.38 | 0.02 |
| 4 GLDA based | 0.25 | 0 |

This example confirms that these liquid detergents, based on different builders, containing cationic starches provide very good drying properties when applied in the main wash of a ware washing process, where is rinsed with fresh water only.

Example 4

In this example the effect of various cationic starches on the drying behaviour of various substrates in a ware washing process was tested. These cationic starches are based on different cationic modifications of several types of starches.

The same dishwash machine, wash process and drying test method was used as described in example 3. First (test 4A: reference) the drying behavior was determined for a wash process in which no rinse components were present. The wash solution in the reference process contained, in soft water: 0.55 g/l sodium tripoly phosphate+0.40 g/l sodium metasilicate+0.02 g/l dichloroisocyanuric acid Na-salt. 2aq (NaDCCA).

Then (test 4B to 4N) the drying behavior was determined for wash processes in which 30 ppm of different cationic starches were present. These wash solutions contained: 0.55 g/l sodium tripoly phosphate+0.40 g/l sodium metasilicate+0.02 g/l dichloroisocyanuric acid Na-salt. 2aq (NaDCCA)+0.03 g/L cationic starch.

In all these trials, no rinse component was dosed in the rinse flow); so rinsed only with fresh soft water.

The materials used as cationic starch in test 4B up to 4N were:

Hi Cat CWS42 (test 4B), ex Roquette, 2-hydroxy-3-(trimethylammonio) propyl ether starch chloride (CAS nr. 56780-58-6);

6 different cationic tapioca starch derivatives from PT. Starch Solution Internasional were tested (test 4C-4H); all with CAS nr. 56780-58-6. These materials have different degrees of cationic substitution (DS) and pH-values; these are given in following overview.

| SolsaCAT | DS mol/mol | pH 10% suspension |
|---|---|---|
| 16 | 0.027 | 4.4 |
| 16A | 0.026 | 3.9 |
| 22 | 0.036 | 5.5 |
| 22A | 0.036 | 4.1 |
| 33 | 0.047 | 5.1 |
| 55A | 0.067 | 4.3 |

3 different Cationic tapioca starches from National Starch & Chemical Limited were tested. These have different degree of cationicity; as follows Cato 304 (test 4I)—quaternary amine (0.25% N)

Cato 306 (test 4J)—quaternary amine (0.30% N)

Cato 308 (test 4K)—quaternary amine (0.35% N)

MERMAID M-350B (test 4L), ex SHIKISHIMA STARCH CO. LTD, α-Cationic Starch (CAS: 9063-45-0).

EXCELL DH (test 4M), ex NIPPON STARCH CHEMICAL CO. LTD, Hydrolyzed starch, hydrogenated-O—C3H5(OH)—N+(CH3)3CL—(CAS 56780-58-6).

EXCELL NL (test 4N), ex NIPPON STARCH CHEMICAL CO. LTD, Syrups Hydrolyzed starch, hydrogenated-O—C3H5(OH)—N±(CH3)3CL—(CAS 56780-58-6); activity 60% (and 40% water).

In table 11 the drying results for these wash processes are given. For each substrate the average values of the drying times and the average values of the number of droplets on the substrates after five minutes for the 3 repeat tests are given.

TABLE 11 drying results in an institutional warewashmachine

| Test | | Glass Time; Sec. | Glass Drop-lets # | Stainless Steel Time; Sec. | Stainless Steel Drop-lets # | Plastic Time; Sec. | Plastic Drop-lets # |
|---|---|---|---|---|---|---|---|
| 4A | Reference | 300 | 8 | 300 | 34 | 300 | 34 |
| 4B | Hi Cat CWS42 | 28 | 0 | 35 | 0 | 180 | 0 |
| 4C | SolsaCAT 16 | 68 | 0 | 158 | 1 | 300 | 4 |
| 4D | SolsaCAT 16A | 38 | 0 | 83 | 0 | 235 | 1 |
| 4E | SolsaCAT 22 | 22 | 0 | 46 | 0 | 195 | 0 |
| 4F | SolsaCAT 22A | 113 | 0 | 214 | 9 | 267 | 2 |
| 4G | SolsaCAT 33 | 95 | 0 | 107 | 0 | 240 | 2 |
| 4H | SolsaCAT 55A | 44 | 0 | 129 | 2 | 272 | 2 |
| 4I | Cato 304 | 117 | 0 | 126 | 2 | 265 | 1 |
| 4J | Cato 306 | 43 | 0 | 70 | 0 | 142 | 0 |
| 4K | Cato 308 | 28 | 0 | 38 | 0 | 154 | 1 |
| 4L | Mermaid M-350B | 33 | 0 | 45 | 0 | 188 | 0 |
| 4M | Excell DH | 27 | 0 | 38 | 0 | 167 | 0 |
| 4N | Excell NL | 32 | 0 | 85 | 0 | 282 | 2 |

The following average drying coefficients can be calculated.

TABLE 12

Average drying coefficients

| Test | | Drying Coefficient: Drying time | Drying Coefficient: Number of remaining droplets |
|---|---|---|---|
| 4B | Hi Cat CWS42 | 0.27 | 0.00 |
| 4C | SolsaCAT 16 | 0.58 | 0.05 |
| 4D | SolsaCAT 16A | 0.40 | 0.01 |
| 4E | SolsaCAT 22 | 0.29 | 0.00 |
| 4F | SolsaCAT 22A | 0.66 | 0.11 |
| 4G | SolsaCAT 33 | 0.49 | 0.02 |
| 4H | SolsaCAT 55A | 0.49 | 0.03 |

TABLE 12-continued

| Average drying coefficients | | | |
|---|---|---|---|
| | | Drying Coefficient | |
| | Test | Drying time | Number of remaining droplets |
| 4I | Cato 304 | 0.56 | 0.04 |
| 4J | Cato 306 | 0.28 | 0.00 |
| 4K | Cato 308 | 0.24 | 0.01 |
| 4L | Mermaid M-350B | 0.30 | 0.00 |
| 4M | Excell DH | 0.26 | 0.00 |
| 4N | Excell NL | 0.44 | 0.02 |

These results show that the wash processes containing various cationic starches, based on different cationic modifications of several types of starches, all provide very good drying on all substrates.

Example 5

In this example, foam formation was tested for wash processes containing cationic starch or cationic guar in combination with different soils. For these trials the following detergents were prepared.

TABLE 13

| Composition detergents | | | | |
|---|---|---|---|---|
| | 1 | 2 | 3 | 4 |
| Hi Cat CWS 42 | 3% | | 1% | |
| Jaguar C1000 | | 3% | | 1% |
| Sodium tripoly phosphate | 50% | 50% | | |
| Sodium meta silicate | 45% | 45% | | |
| Dichloroisocyanuric acid Na-salt 2 aq. | 2% | 2% | | |
| Soft water | | | 29% | 29% |
| Briquest ADPA 60A (60% HEDP-solution) | | | 5% | 5% |
| GLDA 38% solution | | | 15% | 15% |
| Caustic potash (50% KOH solution) | | | 40% | 40% |
| K-silicates 35 Be | | | 10% | 10% |

Detergent 1 and 3 contained a cationic starch: HI-CAT CWS 42 ex Roquette Freres; cold water soluble cationic potato starch (CAS Nr: 56780-58-6).

Detergent 2 and 4 contained a cationic guar: Jaguar C 1000; ex Rhodia; Guar gum, 2 hydroxy-3-(trimethylammonium) propyl ether chloride (CAS Nr: 65497-29-2). This polysaccharide was selected because it provided the best drying properties according to WO 2008/147940.

Detergent 1 and 2 are powder based. Detergent 3 and 4 are liquid detergents; these are prepared by first dissolving the cationic polysaccharide in water at 50 degrees C., followed by adding the other raw materials.

The powder based detergents were dosed at 1 g/L in soft water and the liquid detergents at 2 g/L in the wash process.

Foam formation of these detergents was measured in combination with 2 different soils. In the wash processes containing powder detergents 1 cup (200 ml) of coffee with milk was added. In the wash processes with liquid detergents 1 glass (200 ml) of orange juice was added.

For these trials an institutional single tank warewashing machine was used. The temperature of the wash process was varied and increased in steps of 10 degrees from 30 degrees C. up to 70. No rinse process was applied and foam levels were measured after washing for 60 seconds. The total levels of foam at these 5 different temperatures are given in table 14.

TABLE 14

| Total foam levels of wash processes | | | | |
|---|---|---|---|---|
| | 1 | 2 | 3 | 4 |
| Cationic polysaccharide | cationic starch | cationic guar | cationic starch | cationic guar |
| Foam level | 10 cm | 22 cm | 10 cm | 19 cm |

These test data show that cationic starch is less sensitive for foam formation than cationic guar in these wash processes with different soils. This is an important parameter for mechanical warewashing processes, because foam formation will lead to less mechanical action and so less cleaning performance.

Example 6

Patent application JP 2007-169473 describes the combined use of non-ionic surfactant and cationic polysaccharides in a ware washing product. In this example the effect of non-ionic present in a ware washing product containing cationic starch is tested on various aspects.

For these trials Plurafac LF 403 (ex BASF; fatty alcohol alkoxylate), one of the preferred non-ionics, as mentioned in patent application JP 2007169473, was incorporated both in liquid and solid detergents. In these samples with non-ionic, the ratio of cationic starch/non-ionic varied from 1/2 to about 1/8. Furthermore, reference samples without non-ionics were also tested.

In total 7 powder based and 7 liquid detergents were prepared and tested on drying properties, but also on cleaning, foam formation in wash process, flow properties (powders) and phase separation (liquids). The cationic starches in these tests were:

Hi Cat CWS42, ex Roquette, 2-hydroxy-3-(trimethylammonio) propyl ether starch chloride (CAS nr. 56780-58-6);

EXCELL NL, ex NIPPON STARCH CHEMICAL CO. LTD, Syrups Hydrolyzed starch, hydrogenated-O—C3H5 (OH)—N+(CH3)3CL—(CAS 56780-58-6); activity 60% (and 40% water).

The compositions and weights of the powder based detergents, added to the washing processes are given in table 15A. In all wash processes equal levels of sodium tripoly phosphate (STPP), sodium metasilicate (SMS) and dichloroisocyanuric acid Na-salt. 2aq (NaDCCA) were present.

The levels of Plurafac LF 403 and type of cationic starch were varied in these samples. The calculated ratios of cationic starch/non-ionic are given in last column.

TABLE 15A

Compositions and weights of powder detergents added to wash process; each component is given in grams.

| Nr. | STPP | Plurafac LF 403 | Hi Cat CWS 42 | Excell NL | SMS | NaDCCA | Ratio cat. starch/non-ionic |
|---|---|---|---|---|---|---|---|
| 1 | 25 | | | | 24 | 1 | |
| 2 | 25 | | 1.5 | | 24 | 1 | 1/0 |
| 3 | 25 | 3 | 1.5 | | 24 | 1 | 1/2 |
| 4 | 25 | 7.5 | 1.5 | | 24 | 1 | 1/5 |
| 5 | 25 | | | 1.5 | 24 | 1 | 1/0 |
| 6 | 25 | 3 | | 1.5 | 24 | 1 | 1/3.3 |
| 7 | 25 | 7.5 | | 1.5 | 24 | 1 | 1/8.3 |

The compositions and weights of the liquid detergents, added to the washing processes are given in table 15B. In all wash processes equal levels of Briquest ADPA 60A (60% HEDP-solution), GLDA (38% solution), caustic potash (50% KOH solution) and K-silicates 35 Be were present.

The levels of Plurafac LF 403 and type of cationic starch were varied in these samples. The calculated ratios of cationic starch/non-ionic are given in last column.

TABLE 15B

Compositions and weights of liquid detergents added to wash process; each component is given in grams.

| Nr. | Water | Hi Cat CWS 42 | Excell NL | HEDP 60% | KOH 50% | GLDA 38% | K-silicates 35 Be | Plurafac LF 403 | Ratio cat. starch/non-ionic |
|---|---|---|---|---|---|---|---|---|---|
| 8 | 30 | | | 5 | 40 | 15 | 10 | | |
| 9 | 29 | 1 | | 5 | 40 | 15 | 10 | | 1/0 |
| 10 | 27 | 1 | | 5 | 40 | 15 | 10 | 2 | 1/2 |
| 11 | 24 | 1 | | 5 | 40 | 15 | 10 | 5 | 1/5 |
| 12 | 29 | | 1 | 5 | 40 | 15 | 10 | | 1/0 |
| 13 | 27 | | 1 | 5 | 40 | 15 | 10 | 2 | 1/3.3 |
| 14 | 24 | | 1 | 5 | 40 | 15 | 10 | 5 | 1/8.3 |

These detergents were added to the same dishwashing machine and wash process as described in example 3 and drying behaviour was determined. In all these trials, no rinse component was dosed in the rinse flow; so rinsed only with fresh soft water.

The drying results for these wash processes are given in table 16. For each substrate the average values of the drying times and the average values of the number of droplets on the substrates after five minutes for the 3 repeat tests are given. Furthermore, the average drying coefficients, were calculated and given in last columns.

TABLE 16 drying behaviour of detergents containing cationic starch and non-ionics

| | Stainless steel | | Glass | | Plastic | | Drying coefficient | |
|---|---|---|---|---|---|---|---|---|
| Test Nr. | Time sec. | Droplets | Time sec. | Drop-lets | Time, sec. | Drop-lets | Drying time | Number droplets |
| 1 | 300 | 37 | 284 | 1 | 300 | 24 | | |
| 2 | 130 | 0 | 29 | 0 | 190 | 0 | 0.39 | 0.00 |
| 3 | 300 | 3 | 106 | 0 | 284 | 2 | 0.78 | 0.07 |
| 4 | 300 | 7 | 136 | 0 | 281 | 2 | 0.81 | 0.13 |
| 5 | 298 | 8 | 32 | 0 | 291 | 9 | 0.70 | 0.26 |
| 6 | 300 | 24 | 242 | 1 | 300 | 7 | 0.95 | 0.51 |
| 7 | 300 | 11 | 240 | 1 | 300 | 18 | 0.95 | 0.48 |
| 8 | 300 | 24 | 272 | 3 | 300 | 38 | | |
| 9 | 131 | 0 | 32 | 0 | 251 | 0 | 0.47 | 0.00 |
| 10 | 287 | 5 | 114 | 0 | 295 | 2 | 0.80 | 0.11 |
| 11 | 289 | 4 | 116 | 0 | 285 | 2 | 0.79 | 0.10 |
| 12 | 236 | 1 | 31 | 0 | 300 | 13 | 0.65 | 0.21 |
| 13 | 300 | 13 | 118 | 0 | 300 | 9 | 0.82 | 0.34 |
| 14 | 300 | 9 | 108 | 0 | 300 | 8 | 0.81 | 0.27 |

It can be concluded from these trials that, both for powder based and liquid detergents, the drying behaviour of cationic starches is affected negatively when non-ionic surfactants are also present in these detergents. This is the case for both types of cationic starches tested in these trials. Best drying results are obtained when these cationic starches are not combined with non-ionic surfactants in the wash process.

After the 3$^{rd}$ wash, an extra wash without rinse was executed and foam levels were measured. These results (foam heights in centimeters) are given in table 17.

Furthermore, one extra wash was done and cleaning performance of these wash processes was determined on 2 dishes covered with starch type of soil. Breakfast cereal (Bambix from Nutricia) was applied on these dishes by a brush. The cleaning of these dishes was evaluated visually; these results are given in table 17.

The flow characteristics of the powder based detergents were evaluated by measuring DFR-values (Dynamic Flow Rates). The DFR values were determined by recording the time needed for a powder sample to flow through a vertical tube (4 cm diameter and 30 cm height). The DFR-value was calculated by the ratio: 280/time recorded (in seconds). Higher DFR-value indicates better flow properties for the powder based detergent. The DFR-values are given in table 17. When a powder was not free flowing, this was noted as NF.

For the liquid detergents, physical stability was determined by evaluating phase separation. The volume of separated layer on top of a 100 ml glass test-tube containing 100 ml detergent, was measured. These results are also given in table 17.

TABLE 17

Various parameters of wash processes and detergents containing cationic starch and non-ionics

| Test Nr. | Foam formation, cm | Cleaning starch-soiled dishes, % | DFR, ml/sec | Volume separated layer, ml |
|---|---|---|---|---|
| 1 | 0 | 70 | 138 | |
| 2 | 0 | 70 | 136 | |
| 3 | 3 | 60 | 104 | |
| 4 | 8 | 50 | NF | |
| 5 | 0 | 50 | 123 | |
| 6 | 1 | 7 | NF | |
| 7 | 3 | 10 | NF | |
| 8 | 0 | 80 | | 0 |
| 9 | 0 | 75 | | 0 |
| 10 | 0 | 75 | | 3 |
| 11 | 0 | 70 | | 7 |
| 12 | 0 | 60 | | 0 |
| 13 | 0 | 60 | | 2 |
| 14 | 0 | 50 | | 5 |

It can be concluded from these results that:

The presence of non-ionic surfactants can have a negative effect on foam formation during the wash process. This is the case for the powders based detergents. The powders with cationic starch do not lead to foam formation, while the powders with cationic starch and non-ionic lead to significant foam formation.

The presence of non-ionic surfactants has a negative effect on cleaning performance. Removal of starch type of soil is decreased when non-ionics are present in the wash processes.

The presence of non-ionic surfactants in powder based detergents has a negative effect on the flow properties of these detergents, leading to reduced DFR-values or elimination of all free flowing properties.

The presence of non-ionic surfactants in liquid based detergents has a negative effect on the physical stability of these detergents, leading to phase separation.

The invention claimed is:

1. A method of washing ware comprising:

(a) contacting ware in a washing step with an aqueous cleaning composition in a ware washing machine, the aqueous cleaning composition comprising an aqueous diluent and about 200 to 5000 parts by weight of a ware washing detergent per each one million parts of the aqueous diluent, wherein the ware washing detergent comprises a nonionic surfactant; and (b) contacting the washed ware in a rinse step with an aqueous rinse, the aqueous rinse being substantially free of an intentionally added rinse agent, characterized in that the aqueous cleaning composition contains a sufficient amount of a cationic starch to provide a layer of the cationic starch on the ware so as to afford sheeting action in the aqueous rinse step, wherein a weight ratio of the nonionic surfactant to the cationic starch in the aqueous cleaning composition is at most 0.25/1, further wherein the cationic starch contains a cationic group which is a quaternary ammonium group according to the formula

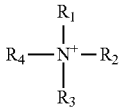

wherein $R_1$, $R_2$, $R_3$ and $R_4$ each independently are a $C_1$-$C_6$ alkyl or a $C_1$-$C_6$ hydroxyalkyl group and further wherein the cationic group is connected to the starch via an ether or an ester linkage.

2. The method according to claim 1, wherein $R_1$, $R_2$ and $R_3$ are identical $C_1$-$C_4$ alkyl groups and $R_4$ is a $C_3$-$C_6$ hydroxyalkyl group.

3. The method according to claim 1, wherein $R_1$, $R_2$ and $R_3$ are methyl groups and $R_4$ is a $C_3$-$C_6$ hydroxyalkyl group.

4. The method according to claim 1, wherein the cationic starch is contained in the detergent and further wherein the weight ratio of the nonionic surfactant to the cationic starch in the detergent is at most 0.25/1.

5. The method according to claim 1, wherein the ware washing machine is an automatic institutional machine and the automatic institutional machine is a single tank or a multi-tank/conveyor machine.

6. The method according to claim 4, wherein the ware washing detergent further comprises a defoaming agent, wherein the defoaming agent and the nonionic surfactant are different chemical compounds having different chemical formulas.

7. The method according to claim 4, wherein the aqueous cleaning composition further comprises a hydrotrope, wherein the hydrotrope and the nonionic surfactant are different chemical compounds having different chemical formulas.

8. The method according to claim 4, wherein the ware washing detergent further comprises a defoaming agent and the aqueous cleaning composition further comprises a hydrotrope, wherein the defoaming agent, the hydrotrope and the nonionic surfactant are different chemical compounds having different chemical formulas.

9. The method according to claim 4, wherein the cationic starch constitutes 0.05% to 5% (w/w) of the ware washing detergent, and further wherein the ware washing machine is an automatic institutional machine and the automatic institutional machine is a single tank or a multi-tank/conveyor machine.

10. The method according to claim 4, wherein the cationic starch constitutes 0.05% to 5% (w/w) of the ware washing detergent, wherein the ware washing detergent further comprises a defoaming agent or the aqueous cleaning composition further comprises a hydrotrope or both, wherein the defoaming agent, the hydrotrope and the nonionic surfactant are different chemical compounds having different chemical formulas, and further wherein the ware washing machine is an automatic institutional machine and the automatic institutional machine is a single tank or a multi-tank/conveyor machine.

11. A method of washing ware comprising:

(a) contacting ware in a washing step with an aqueous cleaning composition in a ware washing machine, the aqueous cleaning composition comprising an aqueous diluent and about 200 to 5000 parts by weight of a ware washing detergent per each one million parts of the aqueous diluent; and (b) contacting the washed ware in a rinse step with an aqueous rinse, the aqueous rinse being substantially free of an intentionally added rinse agent, characterized in that the aqueous cleaning composition contains a sufficient amount of a cationic starch to provide a layer of the cationic starch on the ware so as to afford sheeting action in the aqueous rinse step, wherein the aqueous cleaning composition does not contain a nonionic surfactant, further wherein the cationic starch contains a cationic group which is a quaternary ammonium group according to the formula

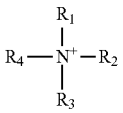

wherein $R_1$, $R_2$, $R_3$ and $R_4$ each independently are a $C_1$-$C_6$ alkyl or a $C_1$-$C_6$ hydroxyalkyl group and further wherein the cationic group is connected to the starch via an ether or an ester linkage.

12. The method according to claim 11, wherein $R_1$, $R_2$ and $R_3$ are identical $C_1$-$C_4$ alkyl groups and $R_4$ is a $C_3$-$C_6$ hydroxyalkyl group.

13. The method according to claim 11, wherein $R_1$, $R_2$ and $R_3$ are methyl groups and $R_4$ is a $C_3$-$C_6$ hydroxyalkyl group.

14. The method according to claim 11, wherein the cationic starch is contained in the ware washing detergent.

15. The method according to claim 11, wherein the ware washing machine is an automatic institutional machine and the automatic institutional machine is a single tank or a multi-tank/conveyor machine.

16. The method according to claim 14, wherein the ware washing detergent further comprises a defoaming agent.

17. The method according to claim 14, wherein the aqueous cleaning composition further comprises a hydrotrope.

18. The method according to claim 14, wherein the ware washing detergent further comprises a defoaming agent and the aqueous cleaning composition further comprises a hydrotrope.

19. The method according to claim 14, wherein the cationic starch constitutes 0.05% to 5% (w/w) of the ware washing detergent, and further wherein the ware washing machine is an automatic institutional machine and the automatic institutional machine is a single tank or a multi-tank/conveyor machine.

20. The method according to claim 14, wherein the cationic starch constitutes 0.05% to 5% (w/w) of the ware washing detergent, wherein the ware washing detergent further comprises a defoaming agent or the aqueous cleaning composition further comprises a hydrotrope or both, and further wherein the ware washing machine is an automatic institutional machine and the automatic institutional machine is a single tank or a multi-tank/conveyor machine.

* * * * *